US008731417B2

(12) United States Patent
Shiori et al.

(10) Patent No.: US 8,731,417 B2
(45) Date of Patent: May 20, 2014

(54) IMAGE FORMING APPARATUS WITH TEMPERATURE DEPENDENT CONTROL UNIT

(75) Inventors: Jun Shiori, Kanagawa (JP); Yukiko Iwasaki, Kanagawa (JP); Masaki Sukesako, Kanagawa (JP); Hiroyuki Sugiyama, Kanagawa (JP); Kazuaki Kamihara, Tokyo (JP); Hironobu Takeshita, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 123 days.

(21) Appl. No.: 13/411,956

(22) Filed: Mar. 5, 2012

(65) Prior Publication Data

US 2012/0230711 A1 Sep. 13, 2012

(30) Foreign Application Priority Data

Mar. 10, 2011 (JP) ..... 2011-025275
Sep. 22, 2011 (JP) ..... 2011-207261

(51) Int. Cl.
*G03G 15/00* (2006.01)

(52) U.S. Cl.
USPC ..... 399/44; 399/91; 399/94

(58) Field of Classification Search
USPC ..... 399/33, 44, 45, 69, 71, 91, 94, 396
See application file for complete search history.

(56) References Cited

U.S. PATENT DOCUMENTS

| | | | | |
|---|---|---|---|---|
| 6,014,532 | A | 1/2000 | Takeichi et al. | |
| 6,542,703 | B1 * | 4/2003 | Jung | 399/44 |
| 7,027,747 | B2 | 4/2006 | Iwasaki et al. | |
| 7,177,559 | B2 * | 2/2007 | Inoue et al. | 399/44 |
| 7,593,652 | B2 | 9/2009 | Takahashi et al. | |
| 7,734,200 | B2 | 6/2010 | Sugiyama et al. | |
| 7,883,089 | B2 | 2/2011 | Sudo et al. | |
| 2008/0003000 | A1 * | 1/2008 | Taki et al. | 399/44 |
| 2009/0279910 | A1 | 11/2009 | Shiori | |
| 2011/0211854 | A1 | 9/2011 | Shiori et al. | |
| 2012/0045235 | A1 * | 2/2012 | Shiori et al. | 399/53 |
| 2012/0070165 | A1 * | 3/2012 | Suzuki | 399/27 |

FOREIGN PATENT DOCUMENTS

| | | |
|---|---|---|
| JP | 4-338780 | 11/1992 |
| JP | 2002-215005 | 7/2002 |
| JP | 2006-251504 | 9/2006 |
| JP | 4339281 | 7/2009 |
| JP | 2010-134407 | 6/2010 |

* cited by examiner

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

An image forming apparatus includes an image carrier; a latent-image forming unit configured to form a latent image on the image carrier; a developing unit configured to develop the latent image on the image carrier with a developer applied onto a developer carrier; a temperature detector configured to detect an internal temperature or an ambient temperature of the developing unit, the internal temperature and ambient temperature varying depending on a temperature of the developer carrier; and a control unit configured to control restriction on number of pages on which image formation is allowed to be performed continuously and cancellation of the restriction, based on the temperature detected by the temperature detector.

20 Claims, 3 Drawing Sheets

IMAGE FORMING APPARATUS WITH TEMPERATURE DEPENDENT CONTROL UNIT

CROSS-REFERENCE TO RELATED APPLICATIONS

The present application claims priority to and incorporates by reference the entire contents of Japanese Patent Application No. 2011-052575 filed in Japan on Mar. 10, 2011 and Japanese Patent Application No. 2011-207261 filed in Japan on Sep. 22, 2011.

BACKGROUND OF THE INVENTION

1. Field of the Invention

The present invention generally relates to an image forming apparatus.

2. Description of the Related Art

Conventionally, a temperature rise occurs in an electrophotographic image forming apparatus and its components when a large amount of sheets is processed by the image forming apparatus continuously over an extended period of time; the temperature rise is caused because an image forming unit is kept to be driven over the extended period of time. Known typical examples that take countermeasure against this temperature rise include image forming apparatuses that use a cooling fan, a duct, and/or the like to prevent the temperature inside the image forming apparatus and temperatures of its components from increasing to a certain temperature or higher and image forming apparatuses of high-speed type that include an air conditioner for adjusting the temperature inside the apparatus and perform temperature control.

Known control schemes for such an image forming apparatus, in which the temperature of a fixing roller locally increases when the apparatus continuously processes small-size sheets, include control of directly monitoring the temperature of the fixing roller, thereby temporarily lengthening sheet-feed intervals or making uneven temperature distribution on the fixing roller even.

Disclosed in Japanese Patent Application Laid-open No. 2010-134407 is an image forming apparatus that calculates a developing-motor variable temperature based on an operation mode of the image forming apparatus, estimates a power-supply-off time over which a power supply is cut off based on a change in the temperature of a fixing thermistor, corrects the developing-motor variable temperature based on the power-supply-off time, and calculates an estimated temperature of the developing motor by adding an environmental temperature to the corrected developing-motor variable temperature in order to control the image forming apparatus appropriately in a manner to prevent an excessive temperature rise of the developing motor without directly detecting the developing motor. When the estimated temperature of the developing motor has increased to be equal to or higher than 100° C., this image forming apparatus performs an image forming process intermittently until the temperature decreases to be lower than 80° C. The intermittent image forming process is performed by repeatedly performing a loop of carrying out the image forming process in a continuous manner and entering a standby state where the image forming process is not performed.

Disclosed in Japanese Patent Application Laid-open No. 2006-251504 is an image forming apparatus that counts the number of dots in a toner image formed on an image carrier. When the counted value is equal to or greater than a predetermined reference value, the image forming apparatus lowers the temperature of a toner layer on a developing roller in order to prevent toner from fixing and sticking to a toner regulating member when a large amount of toner is consumed by performing a series of image forming operations after suspending rotation of the developing roller for a predetermined period of time.

However, the conventional image forming apparatus that cools inside the apparatus using a cooling fan and/or a duct is disadvantageous in that limitation of size, structure, layout, or the like of an image forming apparatus body imposes restriction on the degree of temperature that can be reduced inside the image forming apparatus.

Furthermore, there can be a case that the temperature of some portion where a temperature rise matters in the conventional image forming apparatus cannot be monitored and therefore temperature control cannot be performed. Particularly when an image forming unit that includes a developing unit is continuously driven over an extended period of time, there can be a case where temperatures of a sliding portion(s), such as a bearing, and a developer itself inside the developing unit are considerably increased, undesirably causing the developer (toner) to fuse inside the developing unit. Unfortunately, it is difficult to directly monitor the temperature of the sliding portion and the developer itself.

The image forming apparatus disclosed in Japanese Patent Application Laid-open No. 2010-134407 cannot prevent toner fusing caused by an excessive temperature rise of the toner on the developing roller inside the developing unit.

The image forming apparatus disclosed in Japanese Patent Application Laid-open No. 2006-251504 has not solved a problem that the temperatures of the sliding portion(s), such as the bearing, and the developer inside the developing unit are undesirably considerably increased when the number of dots in the toner image is small, causing toner to fuse in the developing unit.

Therefore, there is a need for an image forming apparatus capable of preventing fusing of a developer on a developer carrier caused by an excessive temperature rise without performing computation of estimating the temperature of the developer carrier or the developer in a developing unit and while avoiding a decrease in efficiency during continuous image forming operation.

SUMMARY OF THE INVENTION

It is an object of the present invention to at least partially solve the problems in the conventional technology.

According to an embodiment, there is provided an image forming apparatus that includes an image carrier; a latent-image forming unit configured to form a latent image on the image carrier; a developing unit configured to develop the latent image on the image carrier with a developer applied onto a developer carrier; a temperature detector configured to detect an internal temperature or an ambient temperature of the developing unit, the internal temperature and ambient temperature varying depending on a temperature of the developer carrier; and a control unit configured to control restriction on number of pages on which image formation is allowed to be performed continuously and cancellation of the restriction, based on the temperature detected by the temperature detector.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Preferred embodiments of the present invention will be described below with reference to the accompanying drawings.

Figure 1:
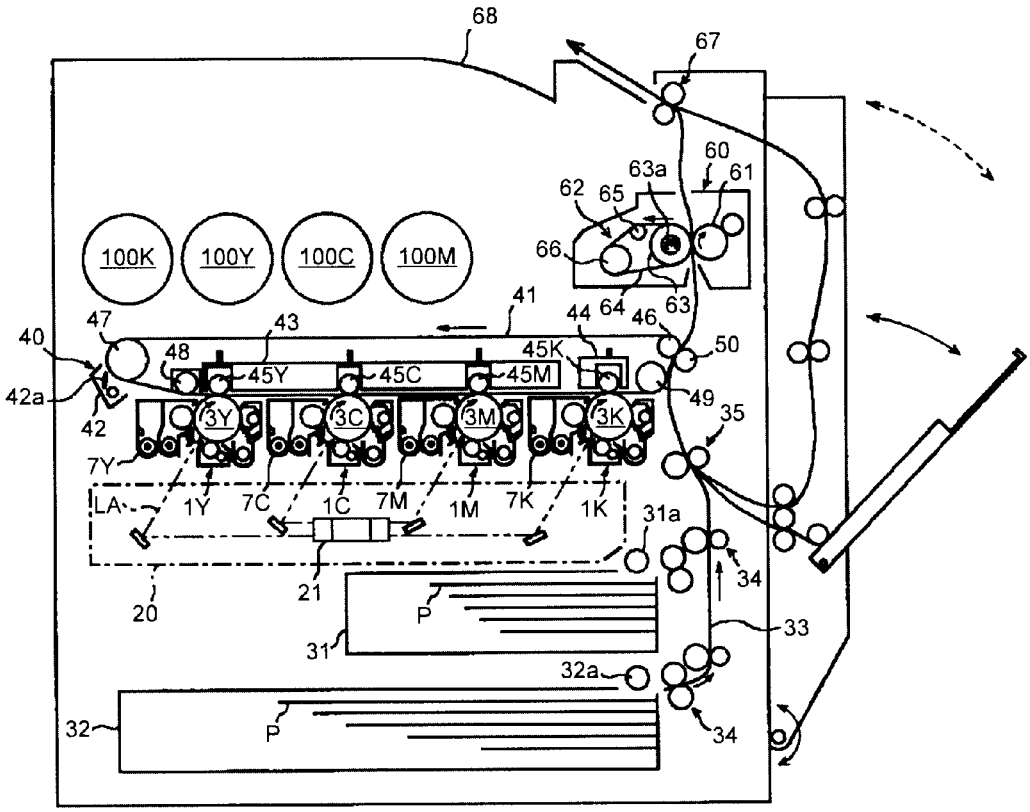
FIG. 1 is a schematic configuration diagram illustrating an overall configuration of a printer which is an image forming apparatus according to an embodiment of the present invention.
Figure 2:
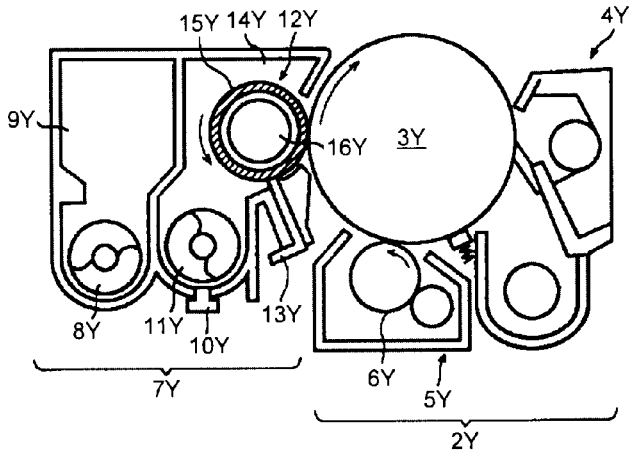
FIG. 2 is a schematic configuration diagram illustrating an example configuration of a yellow-image forming unit for use in the printer.
Figure 3:
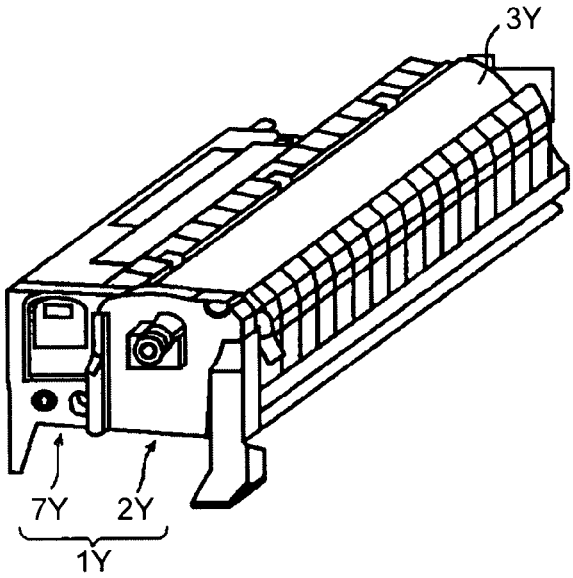
FIG. 3 is a perspective view of the yellow-image forming unit.

FIG. 1 is a schematic configuration diagram illustrating an overall configuration of a printer which is an image forming apparatus according to an embodiment of the present invention. FIG. 2 is a schematic configuration diagram illustrating an example configuration of a yellow-image forming unit 1Y for use in the printer. FIG. 3 is a perspective view of the yellow-image forming unit 1Y.

The printer illustrated in FIG. 1 includes four image forming units, or, more specifically, image forming units 1Y, 1C, 1M, and 1K for forming a yellow (Y)-toner image, a magenta (M)-toner image, a cyan (C)-toner image, and a black (K)-toner image. These image forming units are identical in configuration except for that they use Y toner, C toner, M toner, and K toner that differ from one another in color as image forming substances (developers) with which images are to be formed. Description will be given below by way of an example of the image forming unit 1Y for forming a Y-toner image. As illustrated in FIG. 2, the image forming unit 1Y includes a photosensitive element unit 2Y serving as a latent image carrier, and a developing unit 7Y. The photosensitive element unit 2Y includes a drum-like photosensitive element 3Y. The developing unit 7Y develops a latent image on the photosensitive element 3Y. The photosensitive element unit 2Y and the developing unit 7Y are detachably mounted on a printer body in one piece to serve as the image forming unit 1Y as illustrated in FIG. 3. Note that the developing unit 7Y is detachably mountable on the photosensitive element unit 2Y in a state where the image forming unit 1Y is dismounted from the printer body.

An optical writing unit 20 serving as a latent-image forming unit is arranged below the image forming units 1Y, 1C, 1M, and 1K in FIG. 1. The optical writing unit 20 illuminates photosensitive elements 3Y, 3C, 3M, and 3K, which are uniformly electrostatically charged, of the image forming units 1Y, 1C, 1M, and 1K with laser light LA according to image information. As a result, electrostatic latent images for Y, C, M, and K are formed on the photosensitive elements 3Y, 3C, 3M, and 3K. The optical writing unit 20 causes the laser light LA emitted from a light source to be deflected by a polygon mirror 21 that is rotated by a motor and pass through a plurality of optical lenses and mirrors, thereby illuminating the photosensitive elements 3Y, 3C, 3M, and 3K with the laser light LA. An optical writing unit that performs optical scanning using a light-emitting diode (LED) array can be employed in lieu of the optical writing unit 20 configured as described above.

A first sheet feed cassette 31 and a second sheet feed cassette 32 that feed recording paper P serving as a recording medium are arranged in a vertically stacked fashion below the optical writing unit 20 in FIG. 1. A plurality of sheets of the recording paper P, which is the recording medium, that are stacked in a form of a recording-paper batch is housed in each of the sheet feed cassettes. Each of a first sheet feed roller 31*a* and a second sheet feed roller 32*a* is in contact with an uppermost sheet of the recording paper P in a corresponding one of the cassettes. When the first sheet feed roller 31*a* is rotated counterclockwise in FIG. 1 by a driving unit (not shown), the uppermost sheet of the recording paper P in the first sheet feed cassette 31 is discharged toward a sheet feed path 33 arranged to vertically extend on a right side of the cassette in FIG. 1. When the second sheet feed roller 32*a* is rotated counterclockwise in FIG. 1 by a driving unit (not shown), the uppermost sheet of the recording paper P in the second sheet feed cassette 32 is discharged toward the sheet feed path 33. A plurality of pairs of conveying rollers 34 are arranged on the sheet feed path 33. The recording sheet P delivered onto the sheet feed path 33 is conveyed from a bottom side toward a top side in FIG. 1 while being pinched between the pairs of conveying rollers 34.

A pair of registration rollers 35 are arranged on a downstream end of the sheet feed path 33. The registration rollers 35 temporarily stop their rotations immediately when the pair of registration rollers 35 pinches therebetween the recording paper P delivered from the pairs of conveying rollers 34. The registration rollers 35 send out the recording paper P toward a secondary transfer nip, which will be described later, in an appropriately timed manner.

Arranged above the image forming units 1Y, 10, 1M, and 1K in FIG. 1 is a transfer unit 40 that supports an intermediate transfer belt 41, which serves as an a latent-image forming unit, in a tensioned manner and causes the intermediate transfer belt 41 to move in a counterclockwise loop in FIG. 1. The transfer unit 40 includes, in addition to the intermediate transfer belt 41, a belt cleaning unit 42, a first bracket 43, and a second bracket 44. The transfer unit 40 further includes four primary transfer rollers, or, more specifically, primary transfer rollers 45Y, 45C, 45M, and 45K, a secondary-transfer backup roller 46, a driving roller 47, an auxiliary roller 48, and a tension roller 49. The intermediate transfer belt 41 laid around these eight rollers in the tensioned manner is driven to move in a counterclockwise loop by rotation of the driving roller 47 in FIG. 1. A primary transfer nip is formed between each of the four primary transfer rollers 45Y, 45C, 45M, and 45K and corresponding one of the photosensitive elements 3Y, 3C, 3M, and 3K with the intermediate transfer belt 41 that is moved in the loop as described above interposed therebetween. A transfer bias of polarity (e.g., positive) opposite from that of the toner is applied to a back surface (inner circumferential surface of the loop) of the intermediate transfer belt 41. In a process where the intermediate transfer belt 41 is moved in the loop passing through the primary transfer nips of Y, C, M, and K one by one, the Y-toner image, the C-toner image, the M-toner image, and the K-toner image are transferred as primary transfer from the photosensitive elements 3Y, 3C, 3M, and 3K to a front surface of the intermediate transfer belt 41 to be superimposed on one another. Thus, superimposed four color toner images (hereinafter, referred to as "four color toner images") have been formed on the intermediate transfer belt 41.

The secondary-transfer backup roller 46 that belongs to a secondary transfer unit forms a secondary transfer nip by pinching the intermediate transfer belt 41 between the secondary-transfer backup roller 46 and a secondary transfer roller 50 that is arranged outside of the loop of the intermediate transfer belt 41. The pair of registration rollers 35 sends out the recording paper P pinched between the rollers toward the secondary transfer nip in a manner timed for synchronization with the four color toner images on the intermediate transfer belt 41. The four color toner images on the intermediate transfer belt 41 are collectively transferred onto the recording paper P as secondary transfer by effects of a secondary-transfer electric field generated between the secondary transfer roller 50, to which a secondary transfer bias is applied, and the secondary-transfer backup roller 46, and a nip pressure. The transferred images are combined with white color of the recording paper P, thereby forming a full-color toner image.

Transfer-residual toner that is left on the intermediate transfer belt 41 without being transferred onto the recording paper P even after passing through the secondary transfer nip is cleaned by the belt cleaning unit 42. Meanwhile, the belt cleaning unit 42 brings a cleaning blade 42*a* into contact with the front surface of the intermediate transfer belt 41, thereby scraping off and removing the transfer-residual toner on the belt.

Provided above the secondary transfer nip in FIG. 1 is a fixing unit 60 that fixes a toner image onto the recording paper P. The fixing unit 60 includes a pressing-and-heating roller 61 that internally includes a heat production source, such as a halogen lamp, and a fixing belt unit 62. The fixing belt unit 62 includes a fixing belt 64 serving as a fixing unit, a heating roller 63 that internally includes a heat production source 63*a*, such as a halogen lamp, a tension roller 65, and a driving roller 66. The fixing belt unit 62 moves the endless fixing belt 64 laid around the heating roller 63, the tension roller 65, and the driving roller 66 in a tensioned manner in a counterclockwise loop in FIG. 1. In the process where the fixing belt 64 is moved in the loop, the heating roller 63 applies heat to the fixing belt 64 from a back surface side. The pressing-and-heating roller 61 is in contact with the thus-heated fixing belt 64 from the front-surface side at a position where the fixing belt 64 is laid on the heating roller 63. A fixing nip where the pressing-and-heating roller 61 and the fixing belt 64 contact with each other is thus formed.

A temperature sensor (not shown) is arranged outside of the loop of the fixing belt 64 such that the temperature sensor faces the front surface of the fixing belt 64 with a predetermined clearance therebetween. The temperature sensor detects a surface temperature of the fixing belt 64 immediately before the fixing belt 64 advances into the fixing nip. The detected temperature is transmitted to a fixation-power-supply circuit (not shown). The fixation-power-supply circuit switches on and off power supply to the heat production source 63*a* provided inside the heating roller 63 and a heat production source (not shown) provided inside the pressing-and-heating roller 61 based on the temperature detected by the temperature sensor. By this control, the surface temperature of the fixing belt 64 is maintained at approximately 140° C., for instance.

The recording paper P passed through the secondary transfer nip is separated from the intermediate transfer belt 41 and, thereafter, delivered into the fixing unit 60. The recording paper P is heated and pressed by the fixing belt 64 and the pressing-and-heating roller 61 during a process where the recording paper P nipped in the fixing nip in the fixing unit 60 is conveyed from the bottom side to the top side in FIG. 1. The full-color toner image is thus fixed onto the recording paper P.

The recording paper P having undergone the fixing process as described above is discharged to the outside of the apparatus after passing through a nip between a pair of paper discharging rollers 67. A stacking unit 68 is formed on a top surface of a casing of the printer body. The recording paper P discharged by the pair of paper discharging rollers 67 to the outside of the apparatus is stacked on the stacking unit 68 one after another. Four toner cartridges, or, more specifically, toner cartridges 100Y, 100C, 100M, and 100K that house Y toner, C toner, M toner, and K toner are arranged above the transfer unit 40. The toner of each color in the toner cartridges 100Y, 100C, 100M, and 100K is supplied to a corresponding one of the developing unit 7Y, and developing units 7C, 7M, and 7K of the image forming units 1Y, 1C, 1M, and 1K as required. Each of the toner cartridges 100Y, 100C, 100M, and 100K is detachably mountable on the print body independently of the corresponding one of the image forming units 1Y, 10, 1M, and 1K.

Referring to FIG. 2, the photosensitive element unit 2Y includes the photosensitive element 3Y, a drum cleaning device 4Y, a neutralizing device (not shown), and an electrostatic charging device 5Y serving as an electrostatic charging unit that electrostatically charges the surface of the photosensitive element 3Y. The electrostatic charging device 5Y uniformly electrostatically charges the surface of the photosensitive element 3Y rotated counterclockwise by a driving unit (not shown). The configuration example illustrated in FIG. 2 depicts the electrostatic charging device 5Y of a type that uniformly electrostatically charges the photosensitive element 3Y by bringing an electrostatic charging roller 6Y, which is rotated counterclockwise in FIG. 2 and to which a charging bias is applied from a power supply (not shown), to proximity of the photosensitive element 3Y. An electrostatic charging device that brings an electrostatically charging brush, in lieu of the electrostatic charging roller 6Y, into contact with the photosensitive element 3Y may alternatively employed. Further alternatively, an electrostatic charging device that uniformly electrostatically charges the photosensitive element 3Y by a scheme using a charger, such as a scorotron charger, may be employed. The surface of the photosensitive element 3Y uniformly electrostatically charged by the electrostatic charging device 5Y is scanned for exposure with the laser light LA emitted from the optical writing unit 20 to carry thereon an electrostatic latent image for yellow.

The developing unit 7Y includes a first developer housing unit 9Y in which a first conveying screw 8Y is arranged. The developing unit 7Y further includes a toner density sensor 10Y, a second conveying screw 11Y, a developing roller 12Y serving as a developer carrier, and a second developer housing unit 14Y that includes a doctor blade 13Y serving as a developer regulating member arranged therein. The toner density sensor 10Y serves as a toner density detector and includes a permeability sensor. A Y-developer (not shown) that contains magnetic carriers and negatively-charged Y toner is housed in these two developer housing units 9Y and 14Y. The first conveying screw 8Y is rotated by a driving unit (not shown) to convey the Y-developer in the first developer housing unit 9Y from a near side to a far side in a direction perpendicular to the sheet plane of FIG. 2. The first conveying screw 8Y causes the Y-developer to advance into the second developer housing unit 14Y via a communication opening (not shown) provided in a partition wall between the first developer housing unit 9Y and the second developer housing unit 14Y.

The second conveying screw 11Y in the second developer housing unit 14Y is rotated to convey the Y-developer from the far side to the near side in FIG. 2. The toner density sensor 10Y fixed to a bottom of the second developer housing unit 14Y detects a toner density of the Y-developer on its way of being conveyed. The developing roller 12Y is situated above the second conveying screw 11Y and parallel to the second conveying screw 11Y. The developing roller 12Y includes a developing sleeve 15Y made of a nonmagnetic pipe that is to be rotated counterclockwise in FIG. 2. The developing sleeve 15Y internally includes a magnet roller 16Y. A part of the Y-developer conveyed by the second conveying screw 11Y is lifted onto a surface of the developing sleeve 15Y by magnetic force exerted by the magnet roller 16Y. A layer thickness of the Y-developer on the developing sleeve 15Y is regulated by the doctor blade 13Y that is arranged so as to maintain a predetermined clearance between the developing sleeve 15Y and the doctor blade 13Y. Thereafter, the Y-developer is conveyed to a development area where the Y-developer faces the photosensitive element 3Y to cause the Y toner to stick to the electrostatic latent image for yellow on the photosensitive element 3Y. A Y-toner image is formed on the photosensitive element 3Y as a result of this sticking. The Y-developer of which Y toner has been spent for the development is returned onto the second conveying screw 11Y as the developing sleeve 15Y rotates. When the Y-developer has been conveyed to a near end in FIG. 2, the Y-developer is returned into the first developer housing unit 9Y via the communication opening (not shown).

A permeability of the Y-developer detected by the toner density sensor 10Y is transmitted to a control unit (not shown) as a voltage signal. The value of the voltage output from the toner density sensor 10Y depends the Y-toner density because there is correlation between the permeability of the Y-developer and the density of the Y toner in the Y-developer. The control unit includes memory, such as random access memory (RAM), serving as a storage unit. The memory stores data relating to $V_{tref}$ for Y, which is a target value for an output voltage of the toner density sensor 10Y, $V_{tref}$ for C, $V_{tref}$ for M, and $V_{tref}$ for K, each of which is a target value for an output voltage of a corresponding one of the toner density sensors installed on the other developing units. The developing unit 7Y for Y is controlled such that: the value of the output voltage of the toner density sensor 10Y is compared with the $V_{tref}$ for Y; a toner supplying device for Y, which will be described later, is driven for a period of time that depends on a result of the comparison. By driving the toner supplying device in this way, an appropriate amount of the Y toner is to be supplied to the Y-developer, of which Y-toner density has decreased because the Y toner has been spent for the development, in the first developer housing unit 9Y. As a result, the Y-toner density in the second developer housing unit 14Y is maintained in a predetermined range. The developers in the image forming units (1C, 1M, and 1K) for the other colors are also subjected to same toner supply control as that described above.

An intermediate transfer process of transferring the Y-toner image formed on the photosensitive element 3Y onto the intermediate transfer belt 41 is performed. The drum cleaning device 4Y performs cleaning of removing toner remaining on the surface of the photosensitive element 3Y that has undergone the intermediate transfer process. The surface of the photosensitive element 3Y having undergone the cleaning in this way is neutralized by the neutralizing device (not shown). The surface of the photosensitive element 3Y is reset by this neutralization to be ready for next image forming.

Referring to FIG. 1, a C-toner image, an M-toner image, and a K-toner image are also formed on the photosensitive elements 3C, 3M, and 3K in the image forming units 1C, 1M, and 1K for the other colors, and intermediate transfer of the toner images onto the intermediate transfer belt 41 is performed in a similar manner. Hereinafter, each of the photosensitive elements 3Y, 3C, 3M, and 3K is simply referred to as the developing unit 7; each of the developing units 7Y, 7C, 7M, and 7K as the developing unit 7; each of the developing rollers 12Y, 12C, 12M, and 12K as the developing roller 12; and each of the each of the developing sleeve 15Y, 15C, 15M, and 15K as the developing sleeve 12.

In the printer configured as described above, the temperature sensor (not shown) serving as a temperature detector is arranged in the developing unit 7 or at a position near the developing unit 7 in the image forming apparatus body, or, put another way, at a position where correlation between detected temperatures and internal temperatures of the developing unit is high. This temperature sensor detects a temperature inside or around the developing unit that varies depending on a temperature of the developing sleeve 15. Each of the image forming units for the other colors has a similar configuration.

Figure 4:
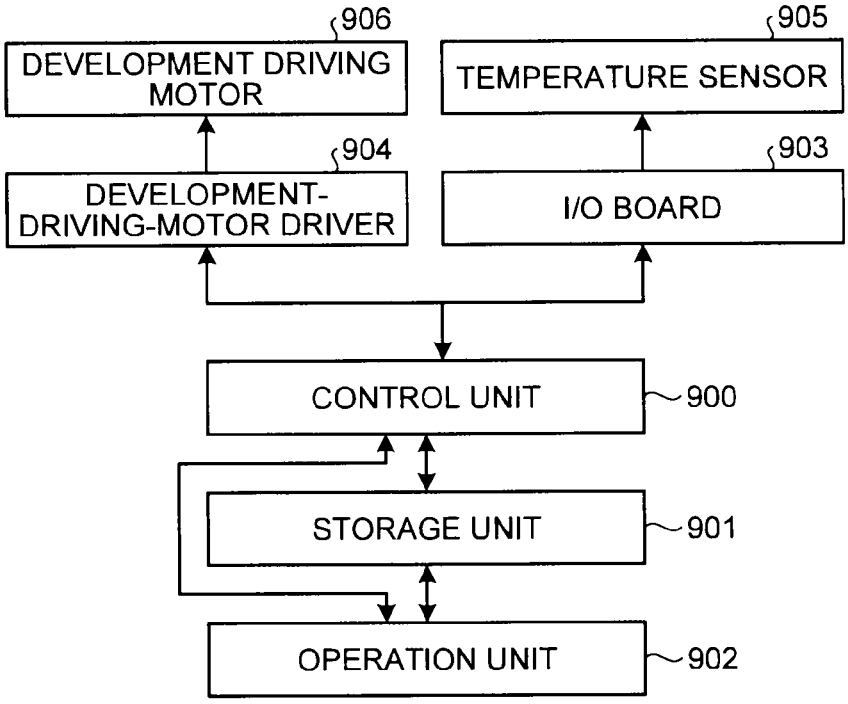
FIG. 4 is a functional block diagram illustrating the configuration of relevant portions of a control system of the printer.

FIG. 4 is a functional block diagram illustrating the configuration of relevant portions of a control system of the printer. Referring to FIG. 4, a control unit 900 includes, for instance, a central processing unit (CPU), read only memory (ROM), and RAM and is connected to a storage unit 901, an operation unit 902 serving as an input unit, an input/output (I/O) board 903 serving as a temperature-detection interface unit, a development-driving-motor driver 904 serving as a developer-carrier driving unit, and the like. The I/O board 903 causes a temperature sensor 905, which is provided in the developing unit 7 or at the position near the developing unit 7 in the image forming apparatus body and serves as the temperature detector, to detect a temperature according to an instruction fed from the control unit 900. The I/O board 903 converts a voltage (detected voltage) of a temperature detection signal output from the temperature sensor 905 into a digital signal and transmits the digital signal to the control unit 900. The development-driving-motor driver 904 supplies a predetermined voltage or electric current to a development driving motor 906, which is a driving source of the developing roller 12, according to an instruction fed from the control unit 900, thereby causing the developing sleeve 15 of the developing roller 12 to rotate at a predetermined rotation speed or switching on/off the rotation. The storage unit 901 includes memory, e.g., a semiconductor memory, a magnetic disk, and/or an optical disk, and stores data about a detected temperature detected by the temperature sensor 905 and setting data relating to various types of control conditions, such as temperature thresholds T1 and T2, which will be described later. The control unit 900 can write to or read from the data in the storage unit 901. The operation unit 902 includes, for instance, various buttons and a touch panel that can be operated by a user, and a liquid crystal display serving as a display unit. The operation unit 902 doubles as an input unit for use in inputting various control conditions. Various types of data input and configured by a user by operating the operation unit 902 is stored in the storage unit 901 via the control unit 900 and can be used in control.

The control unit 900 may be embodied as, for instance, a general-purpose micro computer. All or a part of the control unit 900 may be embodied as an integrated circuit device (e.g., an integrated circuit (IC)) designed to perform control or processing to be described later.

The control unit 900 can perform various types of control and processing, examples of which include (1) to (3) given below, by loading and executing predetermined control program(s).

(1) Issue an instruction for driving the developing roller (2) Calculate a detected temperature from data pertaining to a detected voltage output from the temperature sensor (3) Make determination about and perform shifting to an intervaled-printing operation mode, which will be described later Control examples for the printer configured as described above for controlling operation modes based on a detected temperature are described below.

Control Example 1

According to a first control example (Control Example 1) for the printer according to the present embodiment, the control unit 900 controls operation modes based on the detected temperature, which is a result of the detection performed by the temperature sensor 905, and the predetermined temperature thresholds T1 and T2 as described below.

The control unit 900 issues an instruction for driving the developing roller and converts the detected voltage detected by the temperature sensor 905 into a temperature first. The control unit 900 stores data about the value of the temperature (T° C.), which is a result of the conversion, in the storage unit 901. The control unit 900 compares the current detected temperature T and the predetermined first temperature threshold T1 stored in the storage unit 901 when the control unit 900 stores the data about the detected temperature T. The control unit 900 performs control such that when holds, a shift is made to a restricted image-forming operation mode (hereinafter, referred to as "intervaled-printing operation mode") where number of pages on which image formation can be performed continuously is restricted to a predetermined page count L or smaller. In this intervaled-printing operation mode, the developing unit 7 including the developing roller 12 is stopped for a predetermined period of time R to put the image forming operation in a standby state for every the predetermined page count L even when a print request for continuous printing operation (image forming operation) of a total page count Li (>L) is issued. Put another way, the continuous printing operation (continuous image forming operation) of the multiple, Li pages, printing of which has been requested, is performed intermittently in units of the predetermined L pages.

After the shift to the intervaled-printing operation mode, the control unit 900 compares the current detected temperature T and the predetermined second temperature threshold T2 (<T1) stored in the storage unit 901. The control unit 900 performs control such that when T<T2 holds, the restriction of L, which is the number of pages on which image formation can be performed continuously, is cancelled and the printer returns to a normal image-forming operation mode (hereinafter, referred to as "normal printing mode") where continuous printing operation (continuous image forming operation) can be performed. In this normal printing mode, the printer does not enter the image-forming operation standby state where the developing unit 7 is stopped for a predetermined period of time for every the predetermined page count L but performs the continuous printing operation (continuous image forming operation) of the multiple, Li pages when a print request for continuous printing operation (image forming operation) of the total page count Li (>L) has been issued.

The setting values for the control conditions of the first control example are stored in the storage unit 901. The setting values include the temperature thresholds T1 and T2 for use in determination about a shift to the intervaled-printing operation mode or the normal printing mode, a setting value of L which is the number of pages on which image formation can be performed continuously, and a setting value of a minimum stop time R from a time when driving of the developing roller 12 of the developing unit 7 is stopped to a time when the driving is resumed in the intervaled-printing operation mode.

The setting values for the control conditions, such as the temperature thresholds T1 and T2, stored in the storage unit 901 are changed to input setting values input by a user by operating the operation unit 902. The input setting values can include the setting values for the control conditions, such as the temperature thresholds T1 and T2, a setting value of L which is the number of pages on which image formation can be performed continuously, a setting value of the minimum stop time R. The control conditions, such as the temperature thresholds T1 and T2, can be set as desired by operating the operation unit 902. This makes it possible to configure the control conditions, such as the temperature thresholds T1 and T2, adapted to an actual use environment of the printer or its usage at a location where the printer is actually used or the market. Accordingly, occurrence of a trouble, such as toner fusing caused by a temperature rise of the developing roller 12, can be reduced and a decrease in productivity in printing on recording paper can be minimized.

Figure 5:
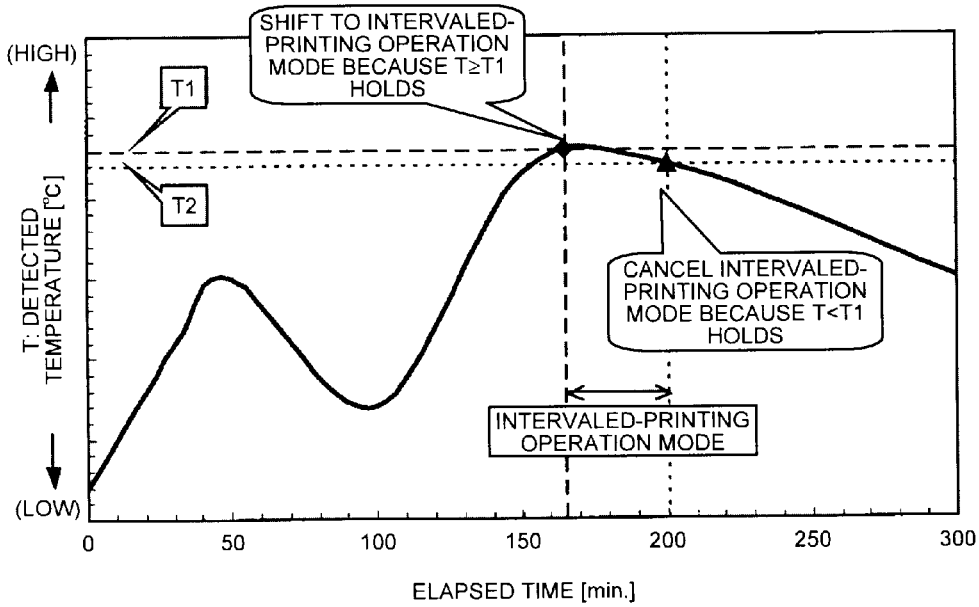
FIG. 5 is a graph illustrating time variation of a detected temperature T when control for shifting to an intervaled-printing operation mode and to a normal printing mode is performed according to a first control example.

FIG. 5 is a graph illustrating time variation of the detected temperature T when control for shifting to the intervaled-printing operation mode and to the normal printing mode according to the first control example (Control Example 1) is performed.

Referring to FIG. 5, the printer shifts to the intervaled-printing operation mode when the detected temperature T (° C.) obtained by the temperature sensor 905 has increased to be equal to or higher than the first temperature threshold T1 in a state where the printer is set in the normal printing operation mode that allows continuous printing operation. In the intervaled-printing operation mode to which the printer has shifted, the printer repeatedly performs the intervaled printing operation with the number of continuous-printing pages restricted to L pages even when a print request for continuous printing of multiple pages (total page count: Li (>L)) has been issued. This increases a total stop time of the developing unit 7 in printing of the total print page count Li and hence makes it possible to prevent a further rise in the temperature of (the developing roller 12 of) the developing unit 7 or to lower the temperature. Furthermore, this makes it possible to control the temperature of the developing unit 7 in a manner more adapted to an actual use environment of the printer or its usage by setting the minimum stop time (standby period) R from a time when driving of the developing unit 7 is stopped to a time when the driving is resumed to a desired value.

Thereafter, it is determined that the temperature of the developing unit 7 has lowered sufficiently when the detected temperature T (° C.) obtained by the temperature sensor 905 has decreased to be lower than the second temperature threshold T2 (<T1) in the intervaled-printing operation mode. At this time, the restriction on the number of continuously-printing pages that has been imposed is cancelled to bring the printer back to the normal printing operation mode where no restriction is imposed on the number of continuously-printing pages.

Meanwhile, the setting values for the control conditions in the intervaled-printing operation mode of the first control example can be changed to desired values by operating the operation unit 902 to adapt to an actual use environment of the printer or its usage. This makes it possible to further reduce occurrence of a trouble, such as toner fusing, caused by a temperature rise of the developing roller 12, and also to minimize a decrease in productivity in printing on recording paper. The setting values include the temperature thresholds T1 and T2, the predetermined page count L which is a limiting value of continuous printing pages, and the minimum stop time R from a time when driving of the developing unit 7 is stopped to a time when the driving is resumed.

Although the temperature thresholds T1 and T2 can be set to desired values using the operation unit 902, setting the temperature thresholds T1 and T2 to values that satisfy a relationship expressed by T1>T2 makes it possible to prevent toner fusing in the developing unit 7 resulting from a sudden rise in temperature that can be caused by continuous printing performed immediately after the restriction on the number of continuously-printing pages is cancelled.

Control Example 2

According to a second control example (Control Example 2) for the printer according to the present embodiment, the control unit 900 controls the operation modes based on the detected temperature obtained by the temperature sensor 905 and a plurality of temperature thresholds TT0, TT1, TT2, and TT3 as described below. The control unit 900 issues an instruction for driving the developing roller and converts a detected voltage detected by the temperature sensor 905 into a temperature first. The control unit 900 stores a temperature value T (° C.), which is a result of the conversion, in the storage unit 901. The control unit 900 compares the current detected temperature T and the first temperature threshold TT1, which is an intervaled-printing-operation-first-invoking temperature threshold, when the control unit 900 stores data about the detected temperature T. The control unit 900 performs control such that when T≥TT1 holds, the printer shifts to a first intervaled-printing operation mode, which is a first-stage restricted image-forming operation mode, where the number of pages on which image formation can be performed continuously is restricted to a predetermined page count L1 or smaller. In this first intervaled-printing operation mode, the developing unit 7 including the developing roller 12 is stopped to put the image forming operation in the standby state for the predetermined period of time R for every the predetermined page count L1 even when a print request for continuous printing operation (image forming operation) of total page count Li (>L1) is issued. Put another way, the printer repeatedly performs the intervaled printing operation where the continuous printing operation (continuous image forming operation) of the multiple, Li pages, printing of which has been requested, is performed intermittently in units of the L1 pages to which the number of continuous print pages is restricted.

After the shift to the first intervaled-printing operation mode, the control unit 900 compares the current detected temperature T and the second temperature threshold TT2 (>TT1), which is an intervaled-printing-operation-second-invoking temperature threshold. The control unit 900 performs control such that when T≥TT2 holds, the printer shifts to a second intervaled-printing operation mode, which is a second-stage restricted image-forming operation mode, where the number of pages on which image formation can be performed continuously is restricted to a predetermined page count L2 (<L1) or smaller. In this second intervaled-printing operation mode, the developing unit 7 including the developing roller 12 is stopped for the predetermined period of time R to put the image forming operation in the standby state for every the predetermined page count L2. Put another way, the printer repeatedly performs the intervaled printing operation in which the continuous printing operation (continuous image forming operation) of the multiple, Li pages, printing of which has been requested, is performed intermittently in units of the L2 pages, to which the number of continuous print pages is restricted.

After the shift to the second intervaled-printing operation mode, the control unit 900 compares the current detected temperature T and the second temperature threshold TT3 (>TT2), which is an intervaled-printing-operation-third-invoking temperature threshold. The control unit 900 performs control such that when T≥TT3 holds, the printer shifts to a third intervaled-printing operation mode, which is a third-stage restricted image-forming operation mode, where the number of pages on which image formation can be performed continuously is restricted to a predetermined page count L3 (<L2) or smaller. In this third intervaled-printing operation mode, the developing unit 7 including the developing roller 12 is stopped for a predetermined period of time to put the image forming operation in the standby state for every the predetermined page count L3 even when a print request for continuous printing operation (image forming operation) of total page count Li (>L3) is issued. Put another way, the printer repeatedly performs the intervaled printing operation in which the continuous printing operation (continuous image forming operation) of the multiple, Li pages, printing of which has been requested, is performed intermittently in units of the L3 pages to which the number of continuous print pages is restricted.

Meanwhile, a relationship expressed by TT1<TT2<TT3 holds among values of the plurality of temperature thresholds TT1 to TT3. More specifically, the number of pages that can be printed continuously decreases mode by mode from the first intervaled-printing operation mode (the first-stage intervaled printing operation) to the third intervaled-printing operation mode (the third-stage intervaled printing operation). For instance, L1, the maximum number of pages that can be printed continuously in the first intervaled-printing operation mode of the first stage, is restricted to 30 pages; L2, the maximum number of pages that can be printed continuously in the second intervaled-printing operation mode of the second stage, is restricted to 10 pages; L3, the maximum number of pages that can be printed continuously in the third intervaled-printing operation mode of the third stage, is restricted to 2 pages.

The control unit 900 compares the current detected temperature T with the fourth temperature threshold TT0, which is an intervaled-printing-operation canceling temperature threshold, after the control unit 900 has performed the plurality of intervaled printing operations by making shifts stepwise from the first intervaled-printing operation mode (the first-stage intervaled printing operation) to the third intervaled-printing operation mode (the third-stage intervaled printing operation) as described above. When T<TT0 holds, the control unit 900 cancels the restriction on the number of pages on which image formation can be performed continuously (limitation pertaining to the intervaled printing operation) to bring the printer back from the third intervaled-printing operation mode to the normal image-forming operation mode where continuous printable (continuous image forming operation) can be performed. In this normal printing mode, the printer does not enter the image-forming-operation standby state where the developing unit 7 is stopped for a predetermined period of time for every the predetermined page count but performs a requested continuous printing operation (continuous image forming operation) of the multiple, Li pages when a print request for continuous printing operation (image forming operation) of the total page count Li (>L1, L2, L3) is issued.

The setting values for the control conditions of the second control example are stored in the storage unit 901. The setting values include the temperature thresholds TT1, TT2, TT3, and TT0 for use in determination about a shift to the intervaled-printing operation mode or the normal printing mode, setting values of the predetermined page counts L1, L2, and L3 which are upper-limit values of the continuous printing pages, and a setting value of the minimum stop time R from a time when driving of the developing unit 7 is stopped to a time when the driving is resumed. The setting values for the control conditions, such as the temperature thresholds TT1, TT2, TT3, and TT0, stored in the storage unit 901 are changed to values input by a user when the user inputs the values of the setting conditions, such as the temperature thresholds TT1, TT2, TT3, and TT0, by operating the operation unit 902. Thus, the control conditions, such as the temperature thresholds TT1, TT2, TT3, and TT0, can be configured as desired by operating the operation unit 902. This allows on-site settings of the temperature thresholds TT0 to TT3 adapted to an actual use environment of the printer or its usage. Accordingly, occurrence of a trouble, such as toner fusing caused by a temperature rise of the developing roller 12, can be reduced and a decrease in productivity can be minimized appropriately.

Figure 6:
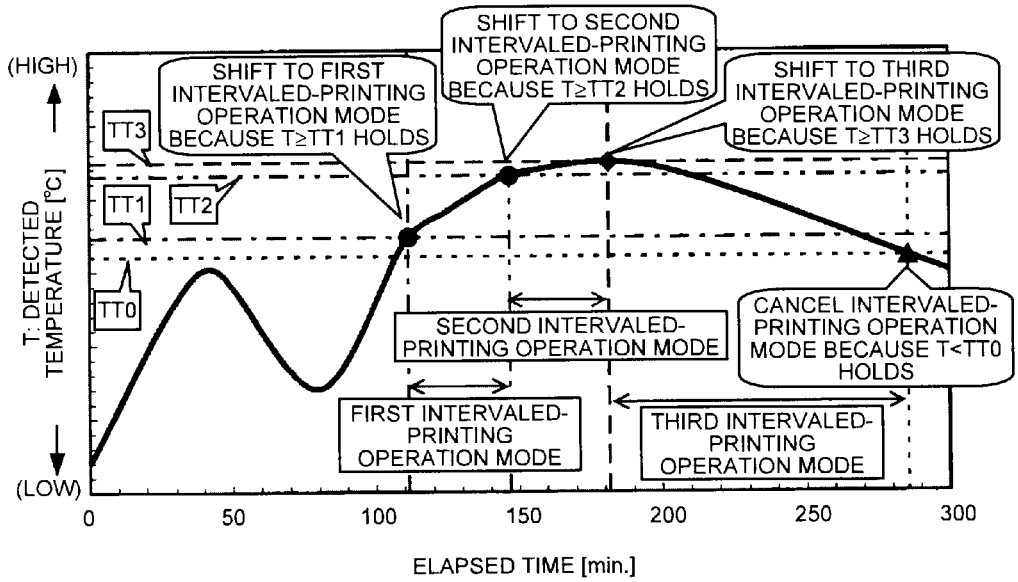
FIG. 6 is a graph illustrating time variation of the detected temperature T when control for shifting to intervaled-printing operation modes and to the normal printing mode is performed according to a second control example.

FIG. 6 is a graph illustrating time variation of the detected temperature T when control for shifts to the intervaled-printing operation modes and to the normal printing mode according to the second control example is performed.

Referring to FIG. 6, when the detected temperature T (° C.) obtained by the temperature sensor 905 has increased to be equal to or higher than the first temperature threshold TT1 in a state where the printer is set in the normal printing operation mode where continuous printing operation can be performed, the printer shifts to the first intervaled-printing operation mode. In the first intervaled-printing operation mode to which the printer has shifted, the printer repeatedly performs the first intervaled printing operation of the first stage in which the maximum number of pages that can be printed continuously is restricted to L1 pages even when a print request for continuous printing of multiple pages (total page count: Li (>L)) is issued. Accordingly, rise in temperature is reduced.

Subsequently, when the detected temperature T (° C.) has increased to be equal to or higher than the second temperature threshold TT2, the printer shifts to the second intervaled-printing operation mode where the maximum number of pages that can be printed continuously is restricted to L2 that is smaller than L1. In the second intervaled-printing operation mode to which the printer has shifted, the printer repeatedly performs the second intervaled printing operation of the second stage in which the maximum number of pages that can be printed continuously is restricted to L2 that is smaller than L1. Accordingly, rise in temperature is further reduced.

Subsequently, when the detected temperature T (° C.) has increased to be equal to or higher than the third temperature threshold TT3, the printer shifts to the third intervaled-printing operation mode where the maximum number of pages that can be printed continuously is restricted to L3 that is still smaller than L2. In the third intervaled-printing operation mode to which the printer has shifted, the printer repeatedly performs the third intervaled printing operation of the third stage in which the maximum number of pages that can be printed continuously is restricted to L3 that is still smaller than L2. Accordingly, rise in temperature is still further reduced.

Thereafter, it is determined that the temperature of the developing unit 7 including the developing roller 12 has lowered sufficiently when the detected temperature T (° C.) has decreased to be lower than the fourth temperature threshold TT0 (<TT1). At this time, the restriction on the number of continuously-printing pages that has been imposed is cancelled to bring the printer back to the normal printing operation mode where no restriction is imposed.

As described above, in the second example, the stop time R of the developing unit 7 increases stepwise during printing of the total print page count Li as the detected temperature T (° C.) increases from TT1 to TT2, and then to TT3. This makes it possible to reduce a rise in the temperature of the developing unit 7 that includes the developing roller 12 or to lower the temperature. Furthermore, a period of time to be spent from start of printing of the total page count, printing of which has been requested, to completion of the printing can be reduced. Accordingly, a decrease in productivity can be reliably minimized.

Although the temperature thresholds TT1, TT2, TT3, and TT0 can be set to desired values using the operation unit 902, setting the first temperature threshold TT1 and the fourth temperature threshold TT0 to values that satisfy a relationship expressed by TT1>TT0 makes it possible to prevent toner fusing in the developing unit 7 resulting from a sudden rise in temperature that can be caused by continuous printing performed immediately after the restriction on the number of continuously-printing pages is cancelled.

Although one example has been described above, each of aspects of the present invention described below yields a specific effect.

According to a first aspect of the embodiments, an image forming apparatus capable of performing an image forming operation on a plurality of pages continuously includes: an image carrier, such as the photosensitive element 3; a latent-image forming unit, such as the optical writing unit 20, that forms a latent image on the image carrier; a developing unit, such as the developing unit 7, that develops the latent image on the image carrier with a developer, such as toner, applied onto a developer carrier, such as the developing roller 12; a temperature detector, such as the temperature sensor 905, that detects an internal temperature T or an ambient temperature T of the developing unit, the internal temperature T and the ambient temperature T varying depending on a temperature of the developer carrier; and a control unit, such as the control unit 900, that controls restriction on number of pages on which image formation is allowed to be performed continuously and cancellation of the restriction, based on the temperature T detected by the temperature detector.

With this configuration, the temperature detector, such as the temperature sensor 905, detects the temperature inside or around the developing unit, such as the developing unit 7, that varies depending on a temperature of the developer carrier, and imposition and cancellation of restriction on the number of pages on which continuous image formation can be performed is controlled based on the detected temperature as described above concerning the embodiment. When it is determined based on the detected temperature that the temperature of the developer carrier, such as the developing roller 12, has excessively risen, restriction is imposed on the number of pages on which continuous image formation can be performed, thereby suspending operation of the developing unit including the developer carrier to prevent an excessive temperature rise of the developer carrier. Accordingly, fusing of the developer on the developer carrier resulting from an excessive temperature rise can be prevented. When it is determined based on the detected temperature that the temperature of the developer carrier has not excessively risen, the restriction on the number of pages on which image formation can be performed continuously is cancelled, thereby allowing continuous image forming operation to be performed without suspending the operation of the developing unit that includes the developer carrier. As a result, a decrease in efficiency during continuous image forming operation can be avoided. Furthermore, it is unnecessary to perform calculation to estimate the temperature of the developer carrier or the developer in the developing unit because imposition and cancellation of the restriction on the number of pages on which image formation can be performed continuously is controlled using a detected temperature inside or around the developing unit that varies depending on the temperature of the developer carrier. Thus, it is possible to prevent fusing of the developer on the developer carrier resulting from an excessive temperature rise without performing computation of estimating the temperature of the developer carrier or the developer in the developing unit and while avoiding a decrease in efficiency during continuous image forming operation.

According to a second aspect of the embodiments, in the image forming apparatus according to the first aspect, the control unit, such as the control unit 900, controls the restriction on the number of pages on which image formation is allowed to be performed continuously and cancellation of the restriction, based on the temperature T detected by the temperature detector, such as the temperature sensor 905, and a plurality of predetermined temperature thresholds. With this configuration, the control unit can compare the temperature detected by the temperature detector against each of the plurality of temperature thresholds to impose and cancel restriction on the number of pages on which image formation can be performed continuously at different detection temperatures and/or impose restriction on the number of pages on which image formation can be performed continuously at a plurality of different temperatures in a multistage manner.

According to a third aspect of the embodiments, in the image forming apparatus according to the first or second aspect, the control unit, such as the control unit 900, performs control in a manner that the number of pages on which image formation is allowed to be performed continuously is restricted to a predetermined page count L or smaller when the detected temperature T obtained by the temperature detector, such as the temperature sensor 905, has increased to be equal to or higher than the predetermined first temperature threshold T1, and, thereafter, the restriction on the number of pages on which image formation is allowed to be performed continuously is cancelled when the detected temperature T is lower than a predetermined second temperature threshold T2. With this configuration, the control unit controls imposition and cancellation of restriction on the number of pages on which image formation can be performed continuously based on the results of comparison between the detected temperature T and each of the temperature threshold T1 and T2 as described above concerning the embodiment. This makes control easy as compared with control that uses a calculation result of temperature estimation.

According to a fourth aspect of the invention, in the image forming apparatus according to any one of the first to third aspects, the control unit, such as the control unit 900, performs control in a manner that a shift to a restricted image-forming operation mode is made when the detected temperature T obtained by the temperature detector, such as the temperature sensor 905, is equal to or higher than a predetermined first temperature threshold T1, the restricted image-forming operation mode being a mode where the number of pages on which image formation is allowed to be performed continuously is restricted to a predetermined page count L or smaller, and a shift to a normal image-forming operation mode is made by canceling the restriction on the number of pages on which image formation is allowed to be performed continuously when the detected temperature T is lower than a predetermined second temperature threshold T2 in the restricted image-forming operation mode. With this configuration, the restriction on the number of pages on which image formation can be performed continuously can be imposed and cancelled by performing simple control of setting the predetermined restricted image-forming operation mode and the normal image-forming operation mode in advance and making shifts to the image-forming operation modes as described above concerning the embodiment.

According to a fifth aspect of the embodiments, the image forming apparatus according to the third or fourth aspect further includes a temperature threshold storage unit, such as the storage unit 901, that stores setting values of the first temperature threshold T1 and the second temperature threshold T2; and a temperature threshold input unit, such as the operation unit 902, through which the setting value of at least one of the first temperature threshold T1 and the second temperature threshold T2 is to be input. The control unit, such as the control unit 900, performs control in a manner that the setting values of the at least one of the first temperature threshold and the second temperature threshold stored in the temperature threshold storage unit are changed to the setting value of the corresponding temperature threshold input through the temperature threshold input unit, and the restriction on the number of pages on which image formation is allowed to be performed continuously and the cancellation of the restriction are performed based on the setting value of the corresponding temperature threshold having been changed and stored in the temperature threshold storage unit. With this configuration, it is possible not only to control shifts to the intervaled-printing operation mode and the normal printing operation mode by setting the temperature thresholds T1 and T2 to desired values but also to change the temperature thresholds T1 and T2 to adapt to an actual use environment or usage at a location where the image forming apparatus is actually used or the market as described above concerning the embodiment. Accordingly, occurrence of a trouble, such as toner fusing resulting from a temperature rise of the developer carrier, such as the developing roller 12, can be reduced and a decrease in productivity during image formation can be minimized.

According to a sixth aspect of the embodiments, in the image forming apparatus according to any one of the third to fifth aspects, a relationship expressed by T1>T2 holds between values of the first temperature threshold T1 and the second temperature threshold T2. With this configuration, it is possible to prevent toner fusing in the developing unit, such as the developing unit 7, that includes the developer carrier, such as the developing roller 12, resulting from a sudden rise in temperature that can be caused by continuous printing performed immediately after the restriction on the number of continuously-printing pages is cancelled as described above concerning the embodiment.

According to a seventh aspect of the embodiments, the image forming apparatus according to any one of the first to sixth aspects further includes: a page-count storage unit, such as the storage unit 901, that stores a setting value of a page count L, the page count L being the number of pages on which image formation is allowed to be performed continuously; and a page-count input unit, such as the operation unit 902, through which the setting value of the page count L is to be input, the page count being the number of pages on which image formation is allowed to be performed continuously. The control unit performs control in a manner that the setting value of the page count L stored in the page-count storage unit is changed to the setting value of the page count L input through the page-count input unit and the restriction on the number of pages on which image formation is allowed to be performed continuously is performed based on the setting value having been changed and stored in the page-count storage unit. With this configuration, it is possible to control the intervaled-printing operation mode by setting the page count L, which is the number of pages on which image formation can be performed continuously, to a desired value adapted to an actual use environment of the image forming apparatus or its usage as described above concerning the embodiment. Accordingly, occurrence of a trouble caused by a temperature rise of the developer carrier, such as the developing roller 12, can be reduced and a decrease in productivity during image formation can be minimized.

According to an eighth aspect of the embodiments, in the image forming apparatus according to the first or second aspect, the control unit, such as the control unit 900, performs control in a manner that the number of pages on which image formation is allowed to be performed continuously is restricted to a first page count L1 or smaller, a second page count L2 or smaller, and a third page count L3 or smaller when the detected temperature T obtained by the temperature detector, such as the temperature sensor 905, is equal to or higher than a predetermined first temperature threshold TT1, a predetermined second temperature threshold TT2, and a predetermined third temperature threshold TT3, respectively, and thereafter, the restriction on the number of pages on which image formation is allowed to be performed continuously is cancelled when the detected temperature T is lower than a predetermined fourth temperature threshold TT0. With this configuration, a shift to the restricted image-forming operation modes and a shift to the normal printing operation mode are controlled based on results of comparison between the detected temperature T and each of the temperature thresholds TT1, TT2, TT3, and TT0 as described above concerning the embodiment. This makes control easy as compared to control that uses a calculation result of temperature estimation. In particular, the stop time R of the developing unit, such as the developing unit 7, for printing of a total print page count increases stepwise as the detected temperature T preferably increases from T1 to T2, and then to T3. This makes it possible to reduce a temperature rise of the developing unit, such as the developing unit 7, that includes the developer carrier, such as the developing roller 12 or to lower the temperature. Furthermore, a period of time to be spent from start of printing of the total page count, printing of which has been requested, to completion of the printing can be reduced, thereby reliably minimizing a decrease in productivity.

According to a ninth aspect of the embodiments, in the image forming apparatus according to any one of the first, second, and eighth aspect, the control unit, such as the control unit 900, performs control in a manner that a shift to a restricted image-forming operation mode where the number of pages on which image formation is allowed to be performed continuously is restricted to a first page count L1 or smaller, a second page count L2 or smaller, and a third page count L3 or smaller is made when the detected temperature T obtained by the temperature detector, such as the temperature sensor 905, is equal to or higher than a predetermined first temperature threshold TT1, a predetermined second temperature threshold TT2, and a predetermined third temperature threshold TT3, respectively, and a shift to a normal image-forming operation mode where there is no restriction on the number of pages on which image formation is allowed to be performed continuously is made when the detected temperature T is lower than a predetermined fourth temperature threshold TT0 in the restricted image-forming operation mode. With this configuration, imposition and cancellation of restriction on the number of pages on which image formation can be performed continuously can be controlled based on results of comparison between the detected temperature T and each of the temperature thresholds TT1, TT2, TT3, and TT0, thereby making control easy as compared to control that uses a calculation result of temperature estimation as described above concerning the embodiment.

According to a tenth aspect of the embodiments, the image forming apparatus according to the eighth or ninth aspect further includes: a temperature threshold storage unit, such as the storage unit 901, that stores setting values of the first temperature threshold TT1, the second temperature threshold TT2, and the third temperature threshold TT3; and a temperature threshold input unit, such as the operation unit 902, through which the setting value of at least one of the first temperature threshold TT1, the second temperature threshold TT2, and the third temperature threshold TT3 is to be input. The control unit, such as the control unit 900, performs control in a manner that the setting value of the at least one of the temperature threshold stored in the temperature threshold storage unit is changed to the setting values of the corresponding temperature threshold input through the temperature threshold input unit, and the restriction on the number of pages on which image formation is allowed to be performed continuously is performed based on the setting value of the corresponding temperature threshold having been changed and stored in the temperature threshold storage unit. With this configuration, it is possible not only to control a shift from the normal printing operation mode to the first intervaled-printing operation mode and shifts between the plurality of intervaled-printing operation modes by setting the temperature thresholds TT1, TT2, and TT3 to desired values but also to change the temperature thresholds TT1, TT2, and TT3 so as to adapt to an actual use environment or usage at a location where the apparatus is actually used or the market as described above concerning the embodiment. Accordingly, occurrence of a trouble, such as toner fusing caused by a temperature rise of the developer carrier, such as the developing roller 12, can be reduced and a decrease in productivity during image formation can be minimized.

According to an eleventh aspect of the embodiments, the image forming apparatus according to any one of the eighth to tenth aspects further includes: a temperature threshold storage unit, such as the storage unit 901, that stores a setting value of the fourth temperature threshold TT0; and a temperature threshold input unit, such as the operation unit 902, through which the setting value of the fourth temperature threshold TT0 is to be input. The control unit, such as the control unit 900, performs control in a manner that the setting value of the fourth temperature threshold TT0 stored in the temperature threshold storage unit is changed to the setting value of the fourth temperature threshold TT0 input through the temperature threshold input unit, and the restriction on the number of pages on which image formation is allowed to be performed continuously is cancelled based on the setting value of the fourth temperature threshold TT0 having been changed and stored in the temperature threshold storage unit.

With this configuration, it is possible not only to control a shift from the third intervaled-printing operation mode to the normal printing operation mode by setting the fourth temperature threshold TT0 to a desired value but also to change the temperature threshold TT0 so as to adapt to an actual use environment or usage at a location where the apparatus is actually used or the market as described above concerning the embodiment. Accordingly, occurrence of a trouble, such as toner fusing caused by a temperature rise of the developer carrier, such as the developing roller 12, can be reduced and a decrease in productivity during image formation can be minimized.

According to a twelfth aspect of the invention, in the image forming apparatus according to any one of the eighth to eleventh aspects, a relationship expressed by TT1>TT0 holds between values of the first temperature threshold TT1 and the fourth temperature threshold TT0. With this configuration, it is possible to prevent toner fusing in the developing unit, such as the developing unit 7, that includes the developer carrier, such as the developing roller 12, resulting from a sudden rise in temperature that can be caused by continuous printing performed immediately after the restriction on the number of continuously-printing pages is cancelled as described above concerning the embodiment.

According to a thirteenth aspect of the embodiments, the image forming apparatus according to any one of the eighth to twelfth aspects further includes: a page-count storage unit, such as the storage unit 901, that stores setting values of the first page count L1, the second page count L2, and the third page count L3; and a page-count input unit, such as the operation unit 902, through which the setting value of at least one of the first page count L1, the second page count L2, and the third page count L3 is to be input. The control unit, such as the control unit 900, performs control in a manner that the setting value of the at least one of the first page count L1, the second page count L2, and the third page count L3 stored in the page-count storage unit is changed to the setting value of the corresponding page count input through the page-count input unit, and the restriction on the number of pages on which image formation is allowed to be performed continuously is performed based on the setting value of the corresponding page count having been changed and stored in the page-count storage unit. With this configuration, it is possible to control the intervaled-printing operation modes by changing each of the setting values of the plurality of page counts L1, L2, and L3, each of which is the number of pages on which image formation can be performed continuously, to a desired value so as to adapt to an actual use environment of the image forming apparatus or its usage as described above concerning the embodiment. Accordingly, occurrence of a trouble caused by a temperature rise of the developer carrier, such as the developing roller 12, can be reduced and a decrease in productivity during image formation can be minimized.

According to a fourteenth aspect of the embodiments, in the image forming apparatus according to any one of the eighth to thirteenth aspects, a relationship expressed by TT1<TT2<TT3 holds among values of the first temperature threshold TT1, the second temperature threshold TT2, and the third temperature threshold TT3, and a relationship expressed by L1>L2>L3 holds among the plurality of the page counts L1, L2, and L3, each of which is the number of pages on which image formation can be performed continuously. With this configuration, the stop time R of the developing unit, such as the developing unit 7, for printing of a total print page count increases stepwise as the detected temperature T increases from TT1 to TT2, and then to TT3, thereby making it possible to reduce rise in the temperature of the developing unit, such as the developing unit 7, that includes the developer carrier, such as the developing roller 12, or to lower the temperature as described above concerning the embodiment. Furthermore, a period of time to be spent from start of printing of the total page count, image formation of which has been requested, to completion of the printing can be reduced, thereby more reliably minimizing a decrease in productivity.

According to a fifteenth aspect of the embodiments, the image forming apparatus according to any one of the first to fourteenth aspects further includes: a stop time storage unit, such as the storage unit 901, that stores a setting value of a stop time R, which is defined as a period of time from when driving of the developer carrier, such as the developing roller 12, is stopped to when the driving is resumed under the restriction on the number of pages on which image formation is allowed to be performed continuously; and a stop time input unit, such as the operation unit 902, through which the setting value of the stop time R is to be input. The control unit performs control in a manner that the setting value of the stop time R stored in the stop time storage unit is changed to the setting value of the stop time R input through the stop time input unit, and the restriction on the number of pages on which image formation is allowed to be performed continuously is performed based on the setting value of the stop time R having been changed and stored in the stop time storage unit. With this configuration, it is possible to perform control by setting the stop time R, which is the period from when the driving of the developer carrier is stopped to when the driving is resumed when the restriction on the number of pages on which image formation can be performed continuously is imposed, to a desired value adapted to an actual use environment of the image forming apparatus or its usage as described above concerning the embodiment. Accordingly, occurrence of a trouble caused by a temperature rise of the developer carrier can be further reduced and a decrease in productivity during image formation can be minimized.

According to the embodiments, a temperature inside or around a developing unit that varies depending on a temperature of a developer carrier is detected, and imposition and cancellation of restriction on the number of pages on which image formation can be performed continuously is controlled based on the detected temperature. When it is determined based on the detected temperature that the temperature of the developer carrier has excessively risen, restriction is imposed on the number of pages on which image formation can be performed continuously, thereby suspending operation of the developer carrier to prevent an excessive temperature rise of the developer carrier. Accordingly, fusing of developer on the developer carrier resulting from an excessive temperature rise can be prevented. When it is determined based on the detected temperature that the temperature of the developer carrier has not excessively risen, the restriction on the number of pages on which image formation can be performed continuously is cancelled, thereby allowing continuous image forming operation to be performed without suspending operation of the developer carrier. As a result, a decrease in efficiency during continuous image forming operation can be avoided. Furthermore, it is unnecessary to perform calculation to estimate the temperature of the developer carrier or the developer in the developing unit because imposition and cancellation of the restriction on the number of pages on which image formation can be performed continuously is controlled using a detected temperature inside or around the developing unit that varies depending on the temperature of the developer carrier. Thus, according to the aspect of the present invention, fusing of the developer on the developer carrier resulting from an excessive temperature rise can be prevented without performing computation of estimating the temperature of the developer carrier or the developer in the developing unit and while avoiding a decrease in efficiency during continuous image forming operation.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier;

a latent-image forming unit configured to form a latent image on the image carrier;

a developing unit configured to develop the latent image on the image carrier with a developer applied onto a developer carrier;

a temperature detector configured to detect an internal temperature or an ambient temperature of the developing unit, the internal temperature and ambient temperature varying depending on a temperature of the developer carrier; and a control unit configured to compare the temperature detected by the temperature detector with a predetermined temperature, then restrict a number of pages on which image formation is allowed to subsequently be performed continuously to a predetermined page count, and subsequently cancel the restriction, based on the temperature detected by the temperature detector.

2. The image forming apparatus according to claim 1, wherein the control unit controls the restriction on the number of pages on which image formation is allowed to be performed continuously and cancellation of the restriction, based on the temperature detected by the temperature detector and a plurality of predetermined temperature thresholds.

3. The image forming apparatus according to claim 1, wherein the control unit performs control in a manner that the number of pages on which image formation is allowed to be performed continuously is restricted to the predetermined page count or smaller when the detected temperature obtained by the temperature detector is equal to or higher than a predetermined first temperature threshold, and thereafter, the restriction on the number of pages on which image formation is allowed to be performed continuously is cancelled when the detected temperature is lower than a predetermined second temperature threshold.

4. The image forming apparatus according to claim 3, further comprising:

a temperature threshold storage unit configured to store setting values of the first temperature threshold and the second temperature threshold; and a temperature threshold input unit through which the setting value of at least one of the first temperature threshold and the second temperature threshold is to be input, wherein the control unit performs control in a manner that the setting values of the at least one of the first temperature threshold and the second temperature threshold stored in the temperature threshold storage unit are changed to the setting value of the corresponding temperature threshold input through the temperature threshold input unit, and the restriction on the number of pages on which image formation is allowed to be performed continuously and the cancellation of the restriction are performed based on the setting value of the corresponding temperature threshold having been changed and stored in the temperature threshold storage unit.

5. The image forming apparatus according to claim 3, wherein the first temperature threshold is higher than the second temperature threshold.

6. The image forming apparatus according to claim 1, wherein the control unit performs control in a manner that a shift to a restricted image-forming operation mode is made when the detected temperature obtained by the temperature detector is equal to or higher than a predetermined first temperature threshold, the restricted image-forming operation mode being a mode where the number of pages on which image formation is allowed to be performed continuously is restricted to the predetermined page count or smaller, and a shift to a normal image-forming operation mode is made by canceling the restriction on the number of pages on which image formation is allowed to be performed continuously when the detected temperature is lower than a predetermined second temperature threshold in the restricted image-forming operation mode.

7. The image forming apparatus according to claim 6, further comprising:

a temperature threshold storage unit configured to store setting values of the first temperature threshold and the second temperature threshold; and a temperature threshold input unit through which the setting value of at least one of the first temperature threshold and the second temperature threshold is to be input, wherein the control unit performs control in a manner that the setting values of the at least one of the first temperature threshold and the second temperature threshold stored in the temperature threshold storage unit are changed to the setting value of the corresponding temperature threshold input through the temperature threshold input unit, and the restriction on the number of pages on which image formation is allowed to be performed continuously and the cancellation of the restriction are performed based on the setting value of the corresponding temperature threshold having been changed and stored in the temperature threshold storage unit.

8. The image forming apparatus according to claim 6, wherein the first temperature threshold is higher than the second temperature threshold.

9. The image forming apparatus according to claim 1, further comprising:

a page-count storage unit configured to store a setting value of a page count, the page count being the number of pages on which image formation is allowed to be performed continuously; and a page-count input unit through which the setting value of the page count is to be input, the page count being the number of pages on which image formation is allowed to be performed continuously, wherein the control unit performs control in a manner that the setting value of the page count stored in the page-count storage unit is changed to the setting value of the page count input through the page-count input unit, and the restriction on the number of pages on which image formation is allowed to be performed continuously is performed based on the setting value having been changed and stored in the page-count storage unit.

10. The image forming apparatus according to claim 1, wherein the control unit performs control in a manner that the number of pages on which image formation is allowed to be performed continuously is restricted to a first page count or smaller, a second page count or smaller, and a third page count or smaller when the detected temperature obtained by the temperature detector is equal to or higher than a predetermined first temperature threshold, a predetermined second temperature threshold, and a predetermined third temperature threshold, respectively, and thereafter, the restriction on the number of pages on which image formation is allowed to be performed continuously is cancelled when the detected temperature is lower than a predetermined fourth temperature threshold.

11. The image forming apparatus according to claim 10, further comprising:

a temperature threshold storage unit configured to store setting values of the first temperature threshold, the second temperature threshold, and the third temperature threshold; and a temperature threshold input unit through which the setting value of at least one of the first temperature threshold, the second temperature threshold, and the third temperature threshold is to be input, wherein the control unit performs control in a manner that the setting value of the at least one of the temperature threshold stored in the temperature threshold storage unit is changed to the setting values of the corresponding temperature threshold input through the temperature threshold input unit, and the restriction on the number of pages on which image formation is allowed to be performed continuously is performed based on the setting value of the corresponding temperature threshold having been changed and stored in the temperature threshold storage unit.

12. The image forming apparatus according to claim 10, further comprising:

a temperature threshold storage unit configured to store a setting value of the fourth temperature threshold; and a temperature threshold input unit through which the setting value of the fourth temperature threshold is to be input, wherein the control unit performs control in a manner that the setting value of the fourth temperature threshold stored in the temperature threshold storage unit is changed to the setting value of the fourth temperature threshold input through the temperature threshold input unit, and the restriction on the number of pages on which image formation is allowed to be performed continuously is cancelled based on the setting value of the fourth temperature threshold having been changed and stored in the temperature threshold storage unit.

13. The image forming apparatus according to claim 10, wherein the first temperature threshold is higher than the fourth temperature threshold.

14. The image forming apparatus according to claim 10, further comprising:

a page-count storage unit configured to store setting values of the first page count, the second page count, and the third page count; and a page-count input unit through which the setting value of at least one of the first page count, the second page count, and the third page count is to be input, wherein the control unit performs control in a manner that the setting value of the at least one of the first page count, the second page count, and the third page count stored in the page-count storage unit is changed to the setting value of the corresponding page count input through the page-count input unit, and the restriction on the number of pages on which image formation is allowed to be performed continuously is performed based on the setting value of the corresponding page count having been changed and stored in the page-count storage unit.

15. The image forming apparatus according to claim 10, wherein the third temperature threshold is higher than the second temperature threshold, the second temperature threshold is higher than the first temperature threshold, the first page count is higher than the second page count, and the second page count is higher than the third page count.

16. The image forming apparatus according to claim 1, wherein the control unit performs control in a manner that a shift to a restricted image-forming operation mode where the number of pages on which image formation is allowed to be performed continuously is restricted to a first page count or smaller, a second page count or smaller, and a third page count or smaller is made when the detected temperature obtained by the temperature detector is equal to or higher than a predetermined first temperature threshold, a predetermined second temperature threshold, and a predetermined third temperature threshold, respectively, and a shift to a normal image-forming operation mode where there is no restriction on the number of pages on which image formation is allowed to be performed continuously is made when the detected temperature is lower than a predetermined fourth temperature threshold in the restricted image-forming operation mode.

17. The image forming apparatus according to claim 16, further comprising:

a temperature threshold storage unit configured to store setting values of the first temperature threshold, the second temperature threshold, and the third temperature threshold; and a temperature threshold input unit through which the setting value of at least one of the first temperature threshold, the second temperature threshold, and the third temperature threshold is to be input, wherein the control unit performs control in a manner that the setting value of the at least one of the temperature threshold stored in the temperature threshold storage unit is changed to the setting values of the corresponding temperature threshold input through the temperature threshold input unit, and the restriction on the number of pages on which image formation is allowed to be performed continuously is performed based on the setting value of the corresponding temperature threshold having been changed and stored in the temperature threshold storage unit.

18. The image forming apparatus according to claim 16, further comprising:

a temperature threshold storage unit configured to store a setting value of the fourth temperature threshold; and a temperature threshold input unit through which the setting value of the fourth temperature threshold is to be input, wherein the control unit performs control in a manner that the setting value of the fourth temperature threshold stored in the temperature threshold storage unit is changed to the setting value of the fourth temperature threshold input through the temperature threshold input unit, and the restriction on the number of pages on which image formation is allowed to be performed continuously is cancelled based on the setting value of the fourth temperature threshold having been changed and stored in the temperature threshold storage unit.

19. The image forming apparatus according to claim 16, wherein the first temperature threshold is higher than the fourth temperature threshold.

20. The image forming apparatus according to claim 1, further comprising:

a stop time storage unit configured to store a setting value of a stop time, the stop time being defined as a period of time from when driving of the developer carrier is stopped to when the driving is resumed under the restriction on the number of pages on which image formation is allowed to be performed continuously; and a stop time input unit through which the setting value of the stop time is to be input, wherein the control unit performs control in a manner that the setting value of the stop time stored in the stop time storage unit is changed to the setting value of the stop time input through the stop time input unit, and the restriction on the number of pages on which image formation is allowed to be performed continuously is performed based on the setting value of the stop time having been changed and stored in the stop time storage unit.

* * * * *

UNITED STATES PATENT AND TRADEMARK OFFICE

CERTIFICATE OF CORRECTION

PATENT NO. : 8,731,417 B2
APPLICATION NO. : 13/411956
DATED : May 20, 2014
INVENTOR(S) : Jun Shiori et al.

It is certified that error appears in the above-identified patent and that said Letters Patent is hereby corrected as shown below:

On the title page, Item (30), the Foreign Application Priority Data Information is incorrect. Item (30) should read:

--(30) Foreign Application Priority Data

Mar. 10, 2011 (JP).....2011-052575
Sept. 22, 2011 (JP).....2011-207261--

Signed and Sealed this
Twelfth Day of August, 2014

Michelle K. Lee

Michelle K. Lee
*Deputy Director of the United States Patent and Trademark Office*